US007423932B1

(12) United States Patent
Jeter

(10) Patent No.: US 7,423,932 B1
(45) Date of Patent: Sep. 9, 2008

(54) WELL BORE COMMUNICATION PULSER

(76) Inventor: John Jeter, P.O. Box 846, St. Martinville, LA (US) 70582

( * ) Notice: Subject to any disclaimer, the term of this patent is extended or adjusted under 35 U.S.C. 154(b) by 393 days.

(21) Appl. No.: 11/403,736

(22) Filed: Apr. 12, 2006

(51) Int. Cl.
*E21B 47/18* (2006.01)

(52) U.S. Cl. ..... 367/85; 175/40; 367/83

(58) Field of Classification Search ..... 367/83, 367/85, 81; 137/269; 175/40
See application file for complete search history.

(56) References Cited

U.S. PATENT DOCUMENTS 4,034,833 A 7/1977 Jeter
5,020,609 A 6/1991 Jerer
5,117,398 A 5/1992 Jeter
5,787,052 A * 7/1998 Gardner et al. ..... 367/84
6,002,643 A * 12/1999 Tchakarov et al. ..... 367/85
2005/0260089 A1 * 11/2005 Hahn et al. ..... 417/505

* cited by examiner

*Primary Examiner*—Albert K Wong
(74) *Attorney, Agent, or Firm*—John D. Jeter

(57) ABSTRACT

The poppet portion of a signal valve is driven rotationally by a mud motor and the rotation is used, in conjunction with a rotary-to-linear motion converter, to cause the poppet to move axially relative to a cooperating orifice in response to initiating action from the related down hole instrument. The rotation of the poppet is optionally used to power an alternator to provide electric power for use in the apparatus.

19 Claims, 6 Drawing Sheets

WELL BORE COMMUNICATION PULSER

This application pertains to apparatus to generate pressure pulse signals in the mud stream, near the lower end of a drill string, to transmit encoded information to the surface for detection in the surface mud stream hydraulic circuit. General use in the Measurement While Drilling (MWD) industry is expected but is not to be construed as a limiting factor.

BACKGROUND

Measurement While Drilling (MWD) is now commonly practiced in the petroleum related drilling industry. The most common apparatus used down hole, for signal generation, is the pressure pulse signal generator. Such apparatus periodically alters the resistance to the flow of the mud stream moving down the drill string bore. Resistance change in the mud stream is usually altered by either a mud siren that generates standing pressure waves, or by digital pulsers that open or close signal valves. The known mud sirens signal by briefly changing the siren speed.

The MWD apparatus can be installed in the drill string while the drill string is on the surface or lowered into the drill string after the drill string is suspended in the well bore. If installed after the drill string is in the well, it is referred to as the shuttle system, and the MWD package is called a shuttle package. In either case, the pulser, in use, is installed in the drill string but the use of the term "installed system" usually means the form installed while the drill string is on the surface, and that relationship will be used herein.

The shuttle package usually contains the mechanical pulser, the instrument package, and a battery pack. Use of the shuttle normally requires azimuthal orientation relative to a scribe line on the drill string if control of well bore direction is expected. The orientation matter usually dictates the use of a mule shoe or it's equivalent in the drill string bore.

The installed version of the pulser usually does not use a battery pack, but generates power down hole with a mud driven turbine and attached alternator. Alternators on shuttle packages are not known to be successful.

The installed version can use either negative or positive signal pulses. The negative pulse is normally generated by briefly opening a mud stream by-pass channel to briefly reduce the mud pressure in surface mud circuits. No known negative pulse generating shuttle pulsers are currently in use.

The demand for shuttle package recovery ability is often related to the cost of the instrument package if the drill string becomes stuck and the pulser system is lost. The cost of the instrument package is constantly dropping and that need may diminish. The pulser and the instrument can be made separable and the instrument alone can be recovered. That decrees a pull-apart overall package. There is no need for the pull-apart feature to contribute to reliability questions. The pull-apart would only be exercised if the system faces loss in the hole.

If pulsers could be depended upon to complete a normal bit run before failure, the version that can be installed at the surface should offer the most desirable performance and reliability features.

These and other objects, advantages, and features of this invention will be apparent to those skilled in the art from a consideration of this specification, including the attached claims and appended drawings.

SUMMARY

The signal valve and the related structure is used in a drill string in a well bore to influence the resistance to the flow of a mud stream moving down the drill string bore.

The signal valve embodies the poppet and orifice form of variable resistance valve. The poppet and the related operating and control gear is, preferably, situated in a housing that is supported in a serial element of the drill string. The poppet, and it's related operating and control gear, may be carried by a shuttle package, or it may be the version installed in the drill string while it is on the surface.

The poppet is rotationally driven, preferably, by attached turbine blades, or vanes, that interact with the moving mud stream to cause the poppet to rotate. The poppet can be rotated by a separate mud motor. The rotating poppet can be fitted with an alternator feature to generate electric power. A rotary motion-to-linear motion converter is provided to move the poppet toward and away from the orifice to comprise a signal valve responsive to signals from the MWD instrument. The linear-to-rotary motion converter options include a spiral clutch, a hydraulic cylinder, and spiral thread-like lands and grooves to drive the poppet toward and away from the orifice to generate digital pulses.

To justify and control the pulser, an MWD instrument is essential but not claimed. Such instruments are currently available to the MWD related enterprises. The instrument can be expected to control current delivered to the instrument from the pulser, to process signals related to poppet position and to control actuation of the poppet. If the pulser has the ability to generate electric power, the instrument may accept the power and convert it to a form useful in data sensing and processing, signal encoding, and management of the pulser.

Whether the pulser is in the installed version or the shuttle version, a separable package may contain the instrument with or without a battery pack, or the battery pack alone may comprise a shuttle package. There are optional provisions for receiving the instrument or battery pack mechanically and electrically atop the pulser housing.

BRIEF DESCRIPTION OF DRAWINGS

In the drawings wherein like features have like captions.

FIG. 3 shows a portion of a related drill string serial element.

DETAILED DESCRIPTION OF DRAWINGS

In the formal drawings, some features that are well established in the art and do not bear upon points of novelty are omitted in the interest of descriptive clarity. Such omitted features may include threaded junctures, weld lines, sealing elements, pins and brazed junctures. The omitted features are familiar to those skilled in the art of machine construction.

The novel apparatus disclosed is the mechanical portion of the pulse creating portion a MWD communication package. The information processing portion of the package is usually referred to as the instrument. The instrument usually has gravitational sensors, and magnetic field sensors and may secure and process assorted data of interest. The instrument converts raw data into code for use in actuating the mud pressure signal generator. In general, the instrument does all the electronic processing and sends an electric signal to the mechanical pulser to generate the preferred signal sequence in the mud stream. The surface gear related to the MWD system detects the pressure pulse code and produces an output signal of use to surface analysts.

The pulser is described as an assembly suspended in the bore of a drill string, with a poppet situated to cooperate with an orifice to function as a signal valve. The same apparatus may be packaged as a shuttle system for lowering down the drill string bore after the drill string is in the well.

Features of the present invention invite the use of rotating elements to drive electric alternators. The cyclic frequence, and the output voltage, is expected to vary. The instrument is expected to receive the electric energy and process that energy for use in the MWD package.

Figure 1:
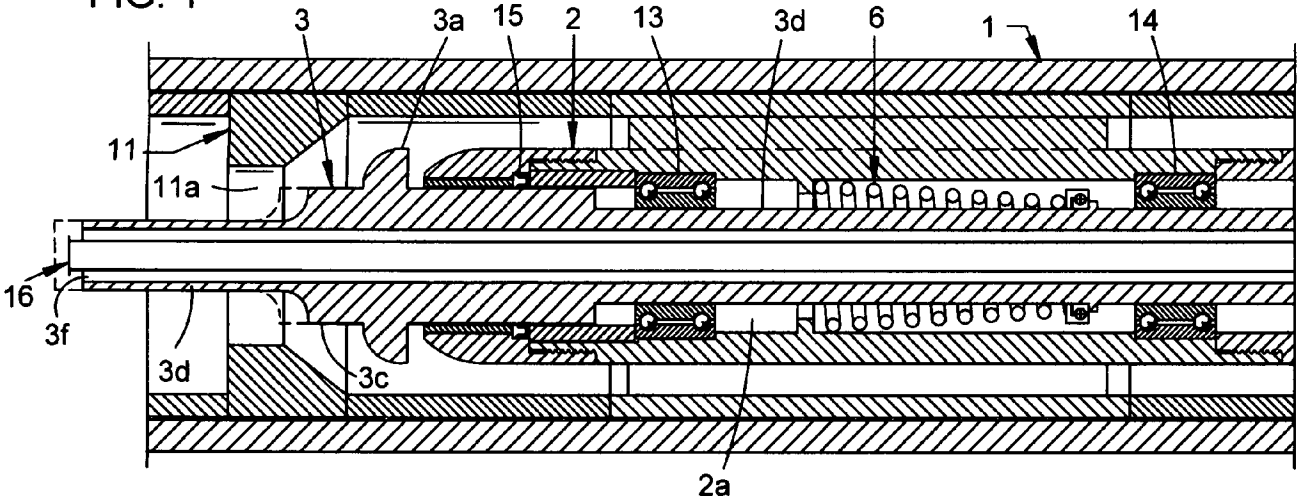
FIGS. 1 and 2 are mutually continuous side views, mostly cut away, of the pulser assembly, which is usually the lower end of the overall MWD assembly.
Figure 2:
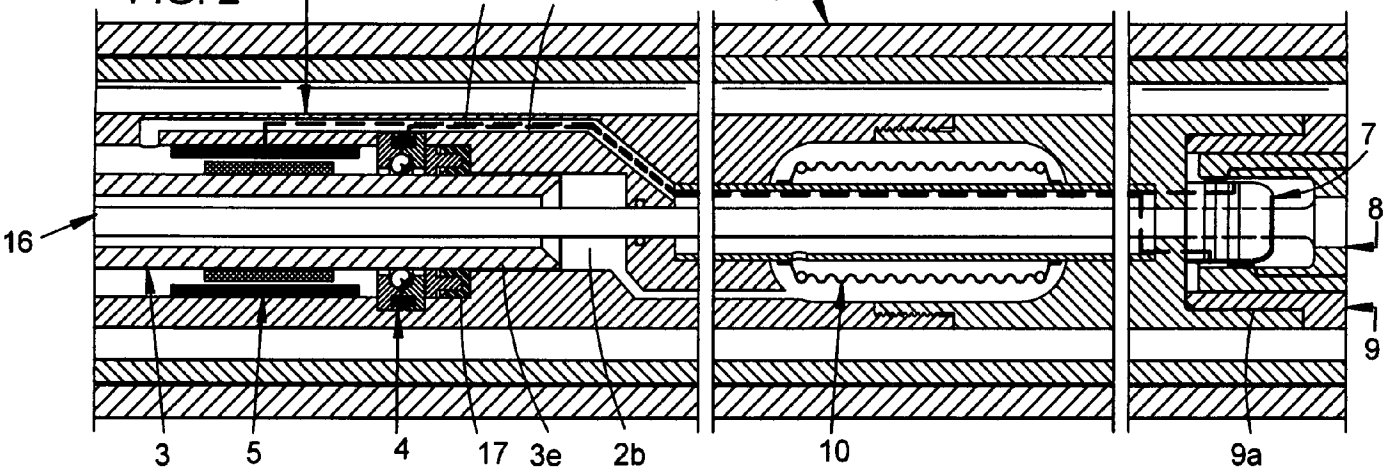
Figure 3A:
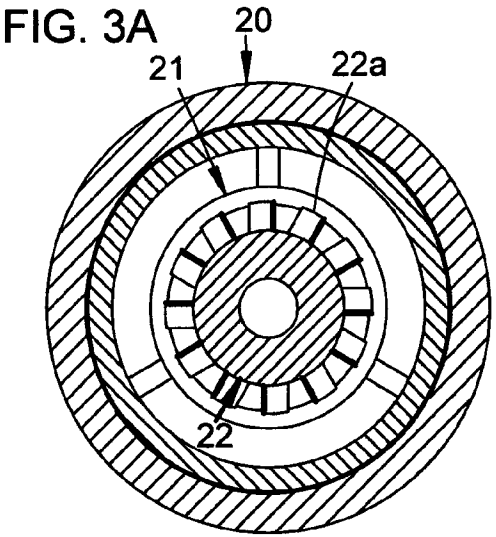
FIG. 3A is a section taken along line 3A-3A.

FIGS. 1, and 2 are mutually continuous and the right end of FIG. 2 represents the interface between the mechanical pulser and the instrument. Juncture 9*a* is symbolic and may be a threaded connection, a slip fit connection, or an equivalent connection.

Drill string serial element 1 carries housing 2, which carries poppet 3 such that the poppet can cooperate with orifice 11*a* to form a signal valve. In some cases, the mud stream moving downward (leftward) all flows through the orifice 11*a*. In some cases, by-pass channels extend through the walls of orifice plate 11 and only part of the mud stream flows through orifice 11*a*.

Figure 15:
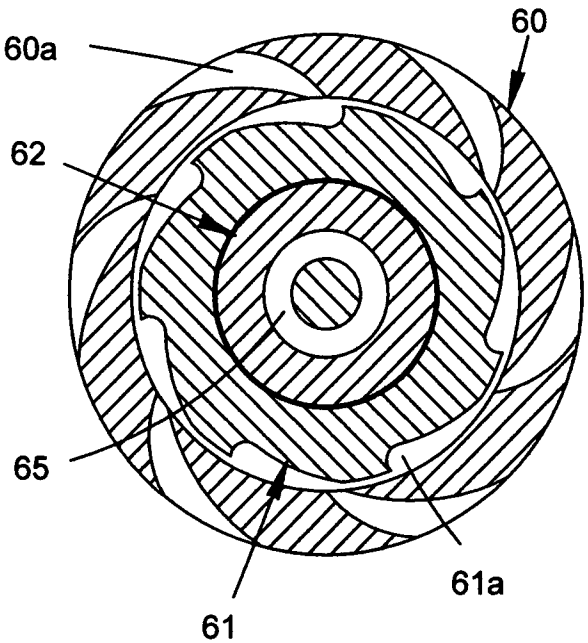
FIG. 15 is a section taken along line 15-15.
Figure 14:
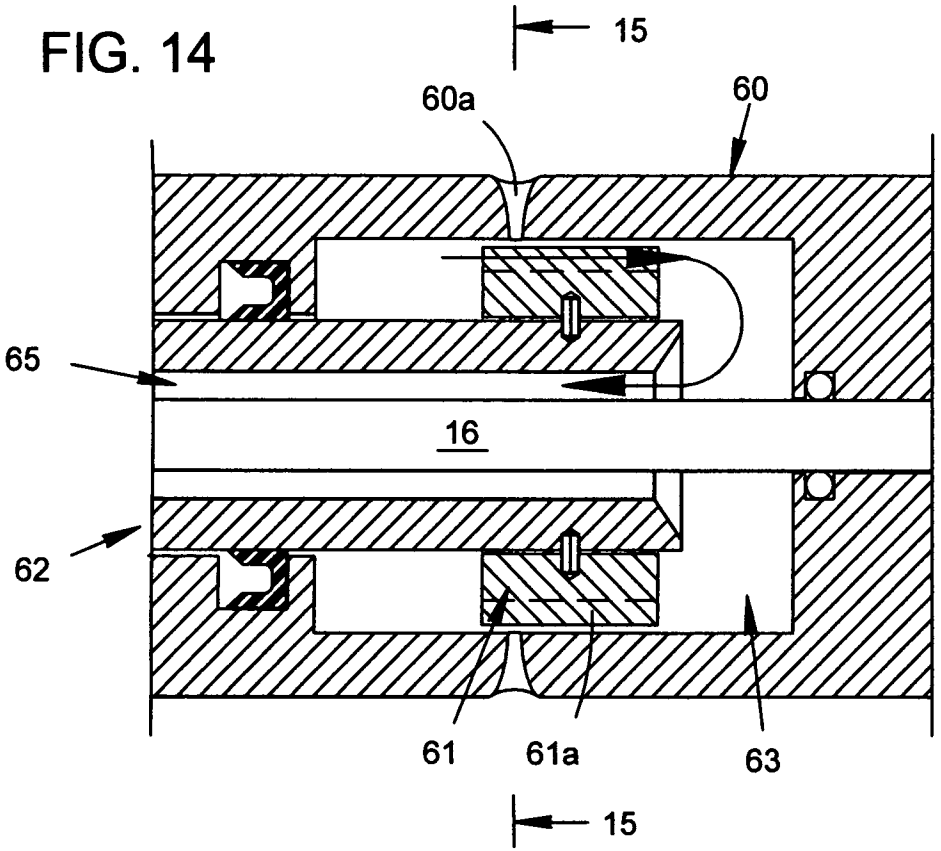
FIG. 14 is a side view of a small portion of the pulser assembly showing the use of an alternate mud motor for rotating the poppet.

Poppet 3 spins, driven by the mud motor vanes 3*a* or by the mud motor of FIGS. 14 and 15. Either one, or both, of the mud motors may be used. Bearings 13 and 14 allow the poppet extension 3*d* to spin and move axially through the bearing bores. Spring 6 urges the poppet upward, or to the signal valve open position.

Between seals 15 and 17, annular space 2*a* of the general enclosure is oil 11 filled. Mud, at the pressure below orifice 11*a*, is conducted through the bore 3*f* of the poppet to chamber 2*b*. Hydrostatic compensator 10 receives mud from chamber 2*b* and delivers oil to the general enclosure.

The orifice restricting hub 3*c* of the poppet has optional extension 3*d* to protect conductor 16 from high velocity mud.

Figure 8:
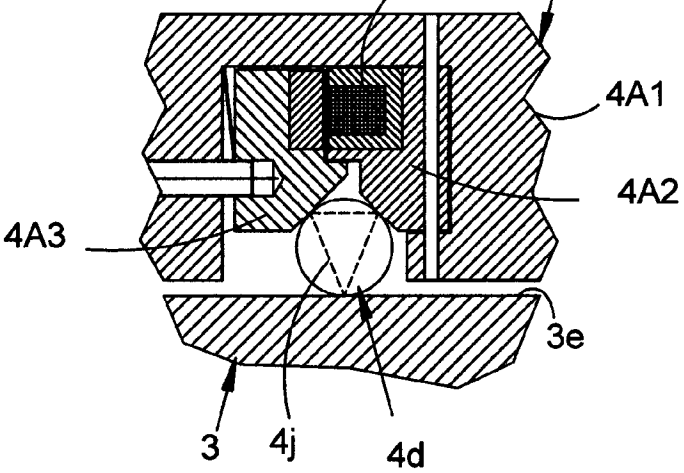
FIGS. 7, 8, and 9 are related to a form of spiral clutch that is optional as a rotary-to-linear motion converter for actuation of a spinning poppet.
Figure 7:
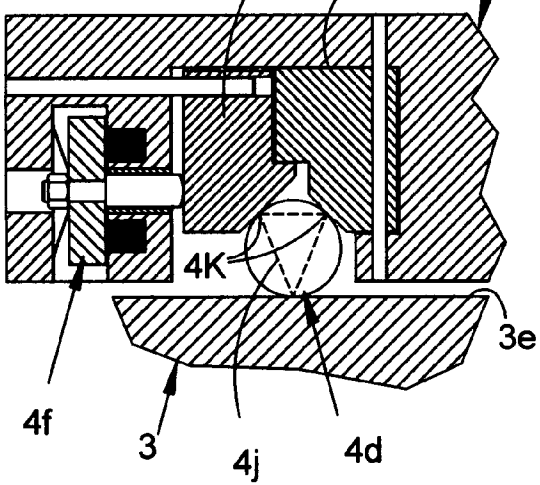
Figure 9:
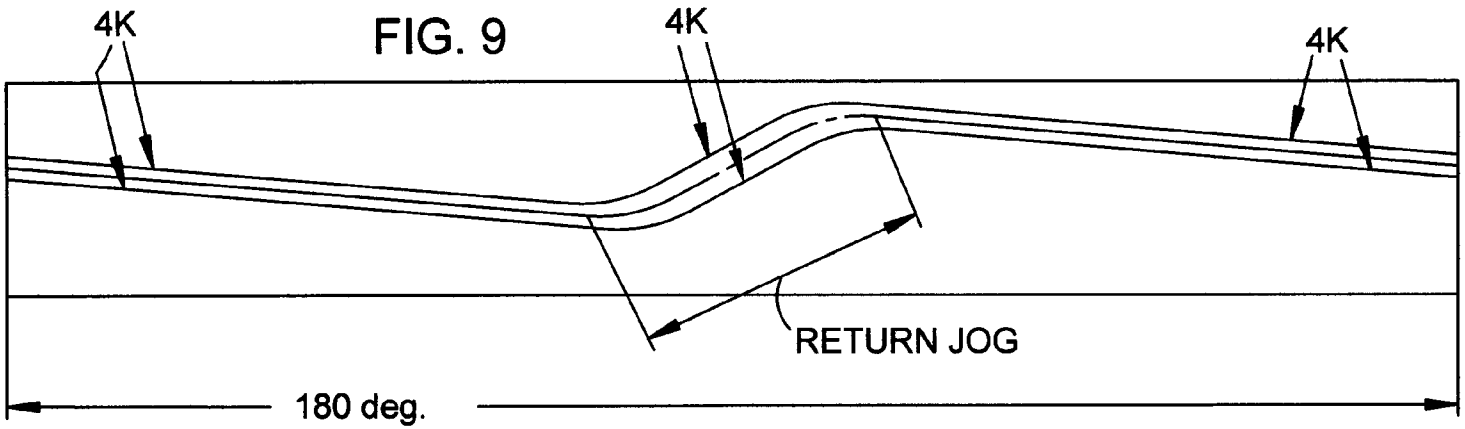

The axial movement of the poppet is controlled by the spiral clutch 4 which is further described in FIGS. 7-9. When the clutch, in response to an activation input form the instrument on conductor 12, engages the peripheral surface of the spinning poppet extension 3*e*, the poppet moves axially. The hand (left or right) of the clutch spiral, and the direction of the poppet spin will move the poppet downward. When the clutch is disengaged it has no influence upon the poppet and the spring 6 returns it to the upper (signal valve open) position.

The alternator 5 is illustrated symbolically. It delivers power to conductor 11 and to the instrument for control, processing, and use in the MWD package.

Communication conductor 16 can extend through the full length of the pulser and to features downstream of the pulser package.

Electric power from the alternator 5 can be used to actuate clutch 4. In that event, a signal from the instrument can operate such as a solid state gate to control the clutch. Only signal energy would be required of the instrument.

Swivel connector nipple 7, receiver socket 8, and instrument housing 9 are optional features and are symbolic of the instrument association with the pulser. Connection 9*a* may be threaded or a slip fit (or an equivalent) for connecting the instrument and pulser portions of the MWD apparatus.

Figure 6:
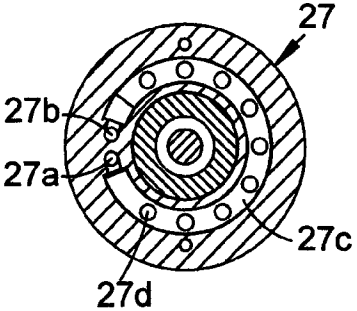
FIG. 6 is a sectional view taken along line 6-6.
Figure 5:
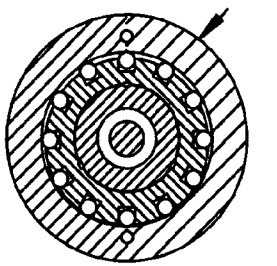
FIG. 5 is a sectional view taken along line 5-5.
Figure 3:
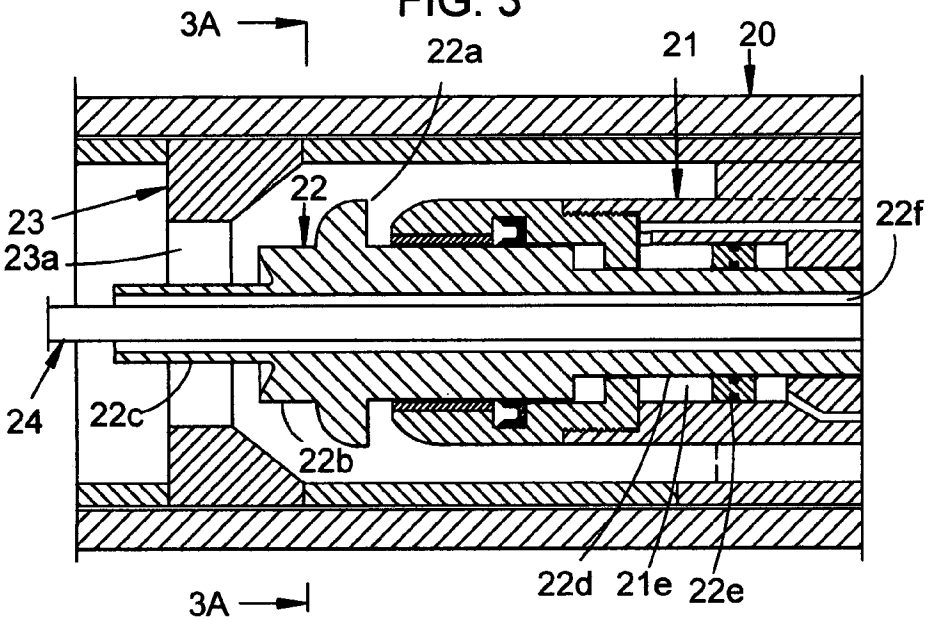
FIGS. 3 and 4 are side views, mostly cut away, of an alternate form of the lower end of the pulser assembly. Only
Figure 4:
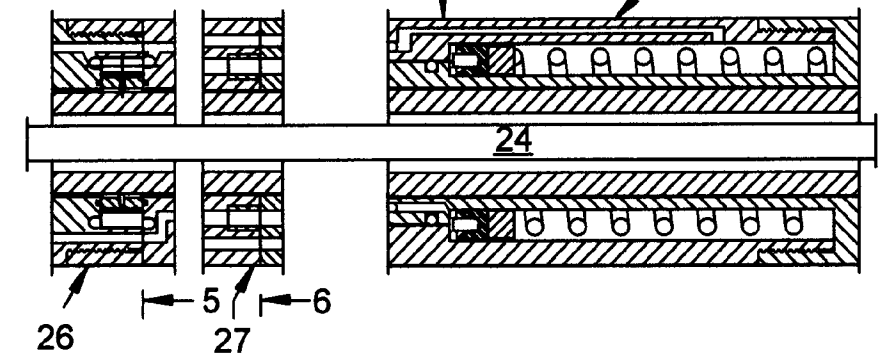

FIGS. 3-6 show a hydraulic equivalent of the spiral clutch form of poppet position control. FIGS. 4-6 omit the drill string element 20 in the interest of clarity. The upper end of the pulser is not shown but will resemble the right end of the apparatus of FIG. 2. Note seal 17, hydrostatic compensator 10. Optional features again include alternator 5.

Drill string serial element 20 carries housing 21 which carries poppet 22 such that it can cooperate with orifice 23*a* to form a signal valve. Poppet 22 has turbine power vanes 22*a* arranged to engage the mud stream to rotate the poppet. Poppet hub 22*b* cooperates with orifice 23*a*, of orifice plate 23, to change the pressure drop across the orifice, when the poppet moves axially. Extension 22*d* carries piston 22*e* which is sealingly situated in cylinder 21*e*. If communication conductor 24 is used, the poppet has shield 22*c* extending into the orifice velocity field to protect the conductor from mud velocity.

Hydraulic compatible features include friction bearings which may be distributed along the poppet, but rolling element bearings such as 13 and 14 of FIG. 1 may be used.

Accumulator 28 offers the ability to reduce the peak torque loads that hydraulic pump 26 places on the poppet 22 when pulses are being generated. A typical hydraulic pump is shown as item 26, shown in FIG. 4. The pump shown is a simple roller pump but many forms of pumps can be used.

The selector valve 27, shown as a section by FIG. 6, is selected to show the peripheral form of armature 27*c*, with ports 27*d*, that is possible. When armature 27*c* changes position, ports 27*d* may open or close selected ducts in the enclosure. This is a pilot actuated valve and is shifted by fluid pressure manipulations addressed to ports 27*a* and 27*b*. A small solenoid valve can manipulate fluid flow to those ports, to save operational energy requirements.

The small solenoid valve is well established in the art. The selector valve, when actuated, changes the direction of the flow of oil to and from the various features such as the cylinder 21*e*, and the accumulator 28. Ordinary spool valves can be made hollow and can function as well as the arcuate armature 27*c* but they, in this case, require more gallery machine work.

FIGS. 7-9 pertain to a spiral clutch that enables the direct conversion of rotary motion to linear motion. This clutch is the subject of U.S. Pat. No. 4,034,833 issued Jul. 12, 1977. It was titled ROLLER CLUTCH, and is a rotary-to-linear motion converter. The clutch can engage and release a smooth shaft in response to very small movement of one part of the clutch assembly. That saves actuation energy 11 which is important to the usual MWD apparatus.

In FIG. 7, stationary race 4*b* and movable race 4*c* engage ball 4*d* and push it against the cylindrical surface 3*e* of poppet 3. The ball is contacted at three points, at the corners of triangle 4*j*. The triangle leg between points on tracks 4K is not parallel to the longitudinal axis of poppet 3. Magnet system 4*f*, when energized, forces race 4*c* against the ball, which causes load on the three points of the triangle 4*j*. When the magnet system 4*f* is not energized, the ball in not urged against the surface 3*e* and it rolls along the path between the races without gripping the surface 3*e*. If poppet 3 rotates while the clutch is energized, it must also move axially in a direction related to the direction of poppet rotation and the spiral direction of the tracks 4K made by the engaged ball. FIG. 9 illustrates the process of movement control.

FIG. 8 shows a clutch identical to that of FIG. 7 except for the manner of moving the movable race, now 4A3. The stationary race 4A2 contains, or is part of, a solenoid 4A4. The solenoid, when energized, pulls the two races, 4A2 and 4A3, together and forces the ball 4*d* against surface 3*e*. This clutch format, now shown as 4A, is the format shown by FIG. 2. The clutch carrying structure, 4*a* or 4A1 is part of or attached to housing 2 of FIG. 2. Ball 4*d* is one of a plurality of balls.

The clutches shown move the poppet in only one direction. If the pulser design is such that the poppet needs to be forced in both axial directions, to both close and open the signal valve, two clutches can be used. Two cooperating clutches would have oppositely spiraled tracks and would be alternately energized to yield reciprocating movement.

FIG. 9 is a development of an imaginary surface that contains the tracks 4K of FIG. 7. It can be assumed that the view is from the longitudinal axis of poppet 3. In the area of the return jog, the tracks 4K separate to keep the ball from being forced against the poppet in that area when the clutch is energized. When the clutch is not energized, the tracks move farther apart along their full length. The development shown is one-half of a full circle.

Figure 10:
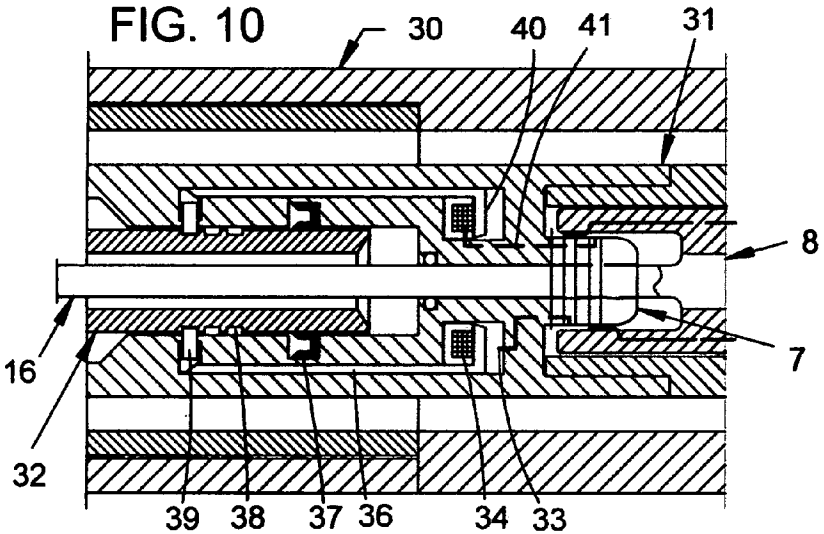
FIG. 10 is a side view, mostly cut away, of an alternate form of the poppet control assembly.
Figure 11:
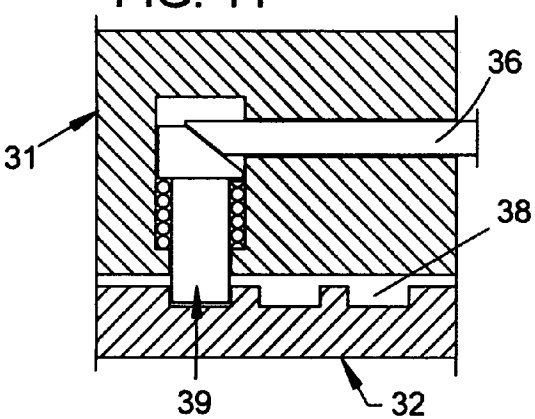
FIG. 11 is a view, somewhat enlarged, of a portion of the assembly of FIG. 10.

FIGS. 10 and 11 show the upper end of a poppet 32 which is moved axially by an alternate process. Spiral grooves 38 are engaged by pins 39 when solenoid coil 34 is energized. Annular armature 40 responds to an energized coil 34 to move actuator rods 36 to wedge the pins into the groove. The spinning poppet moves axially until grooves 38 end and cams the pins outward to force the armature 40 to the right. A symbolic electric switch is represented by wire 33 which engages the moved armature 40 to complete an electric circuit which sends a signal along electric conductor 33 through coupling 7 and 8 to the instrument. The instrument regulates coil 34 by way of conductor 41. Housing 31 commonly carries the MWD instrument as well as the mechanical pulser. The drill string element 30 is usually a committed serial element of the overall drill string.

Seal 37 allows the poppet to be open centered and to house a signal or power conductor 16 which may extend axially through, at least, the mechanical pulser.

FIG. 11 shows the pin 39 and related push rod 36 in larger scale.

Figure 12:
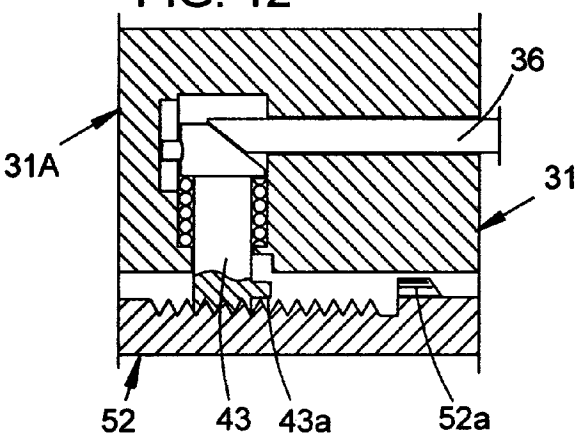
FIG. 12 is identical to FIG. 11, but using some alternate contours.

FIG. 12 shows a rotary-to-linear motion converter commonly found on drill press type tapping machines. Housing 31A carries partial nut 43 which is cammed by push rod 36 to engage threads on the spinning poppet 52. When the poppet has moved full stroke, lift cam 52*a* engages follower cam 43*a* to force the pin 43 outward. Armature 40 is forced toward the symbolic switch formed by wire 33, which causes the instrument to de-activate coil 34. The poppet is then allowed to move under alternate influence, such as spring 6, to the starting poppet position, usually the open position.

Figure 13:
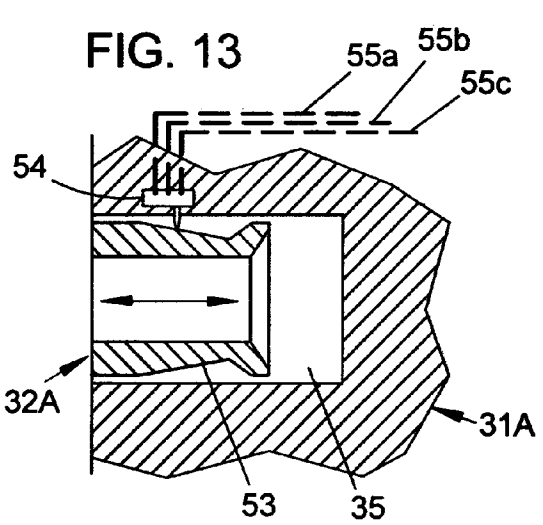
FIG. 13 is a fragmented view, somewhat enlarged, of a selected area of FIG. 10, showing an alternate assembly for sensing the position of the poppet.

FIG. 13 shows a poppet position detecting arrangement. The upper end of a poppet 32A is shaped such that switch 54 with a probe engaging surface 53 can be set to make or break a circuit when the poppet is at a selected axial position. Conductors 55*a*, 55*b*, and 55*c* are symbolic and could lead to the instrument. The instrument could use the information to control the rotary-to-linear motion converter and regulate the signal generation by the poppet. Opening 35 in housing 31A is symbolic in terms of shape. Alternate forms of position sensing are familiar to those skilled in the art.

FIGS. 14 and 15 show a mud motor situated to drive the poppet rotationally. It can function as the only mud motor, or work in conjunction with turbine blades 3*a* of FIG. 1. The open poppet bore 65 is a suitable low pressure fluid dump for the motor. Housing 60, with opening 63 has jets 60*a* directing mud streams against the rotor 61 to provide torque. Torque is delivered to poppet 62. The poppet moves axially and the rotor may be arranged to be attached to and move with the poppet. If the rotor moves axially, the rotor flutes 61*a* may be elongated.

If the mud motor of FIG. 14 is needed only to drive the alternator 5, it does not need to be attached to the poppet. The mud motor and the alternator can be mounted separately from the poppet and still use the poppet bore for mud discharged from the motor. Such mounting is familiar to those skilled in the art.

Figure 16:
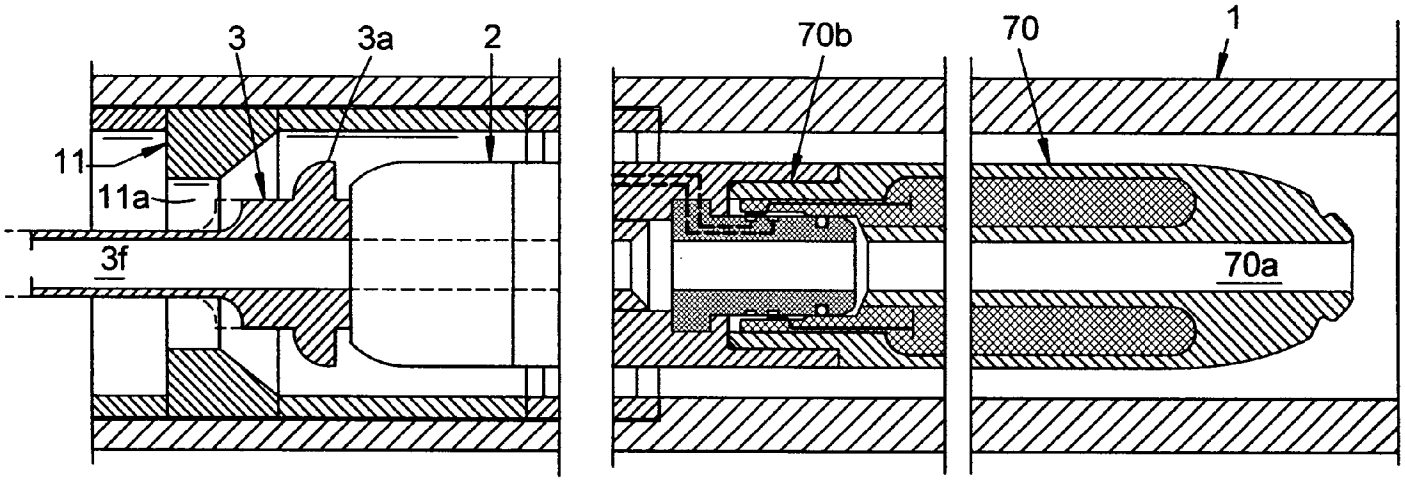
FIG. 16 is a side view, mostly cut away, of a pulser package having a generally central bore extending through the full length of the MWD package.

FIG. 16 shows an attenuated view of the already explained mechanical portion of the pulser package. The instrument portion of the housing has a generally central bore 70*a* and a pull-apart connector 70*b* to enable recovery of the instrument from a potentially lost MWD package. The essential instrument is not claimed in detail and the related parts are shown as a double hatched area. The open bore also invites the use of portions of the instrument, situated in a separate housing and well below the pulser, to transmit information into the housing to directly control the pulser or for further processing and eventual control of the pulser.

Figure 17:
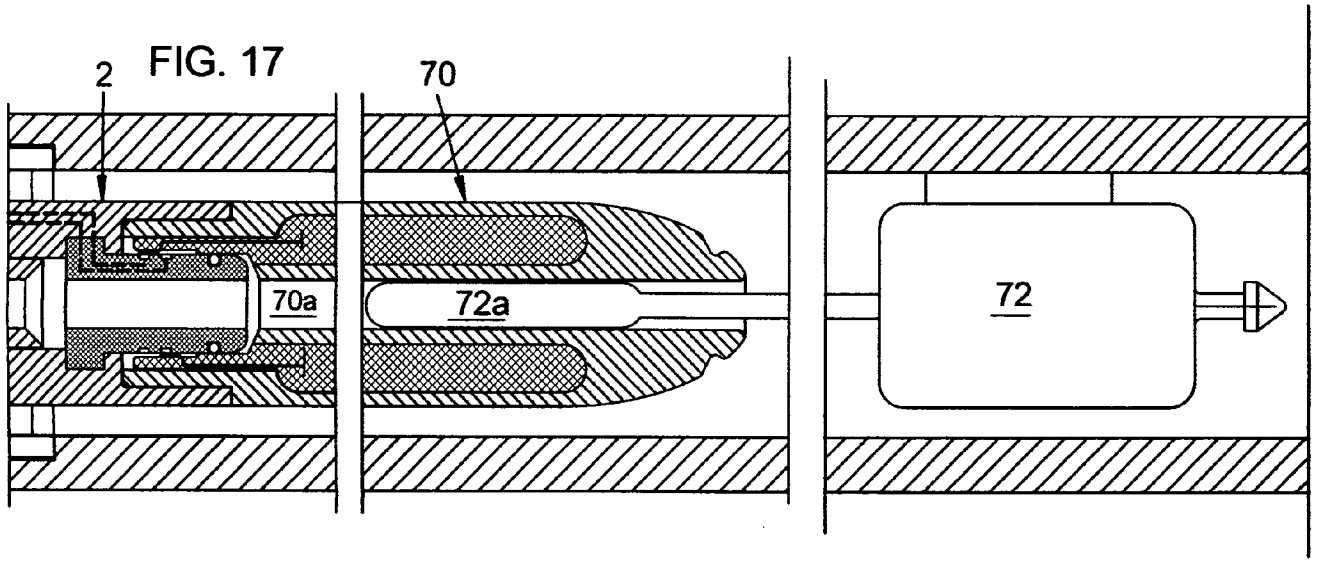
FIG. 17 is a side view, mostly cut away, showing an alternator spaced from but arranged to feed electric power to the instrument portion of the MWD package.

FIG. 17 shows the arrangement if FIG. 16 with an alternator 72 well above the instrument and providing power to the instrument through an induction coupler 72*a*.

From the foregoing, it will be seen that this invention is one well adapted to attain all of the ends and objects hereinabove set forth, together with other advantages which are obvious and which are inherent to the apparatus.

It will be understood that certain features and sub-combinations are of utility and may be employed without reference to other features and sub-combinations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

The invention having been described, I claim:

1. A pressure signal pulse generating apparatus for use in a drill string suspended in a well bore to generate changes in the resistance to the flow of a mud stream flowing down the bore of said drill string, said changes containing characteristics that are interpreted at the surface to derive information encoded into the changes at the down hole location, the apparatus comprising:

a) a body comprising a serial element of said drill string;

b) a signal valve, situated in said body, through which at least part of said mud stream flows, and comprising an orifice and a cooperating poppet arranged to move between a generally closed position and a generally open position;

c) at least one motor, situated in said body, arranged to rotate said poppet;

d) a controlling instrument situated in said body; and e) a rotary-to-linear motion converter arranged to axially move said poppet relative to said orifice in response to controlling actions of said instrument.

2. The apparatus of claim 1 wherein said motor is powered by movement of said mud stream and comprises turbine vanes situated on said poppet.

3. The apparatus of claim 1 wherein said motor is powered by a by-pass mud stream driven by the pressure difference across said signal valve.

4. The apparatus of claim 1 wherein an electric power producing alternator is provided and is driven by said poppet.

5. The apparatus of claim 1 wherein said rotary-to-linear motion converter is a spiral clutch arranged to releasably grip a cylindrical surface on said poppet, in response to electric signals from said instrument.

6. The apparatus of claim 5 wherein said electric signals provide controls to direct power from an alternator, in said housing, to said spiral clutch.

7. A pressure signal pulse generating apparatus for use in a drill string suspended in a well bore to generate changes in the resistance to the flow of a mud stream flowing down the bore of said drill string, said changes containing characteristics that are interpreted at the surface to derive information encoded into the changes at the down hole location, the apparatus comprising:

a) a body comprising a serial element of said drill string;

b) a housing supported in said body and situated to contain a down hole instrument;

c) a signal valve, situated in said body, through which at least part of said mud stream flows, and comprising an orifice and a cooperating poppet;

d) a motor, situated in said housing, arranged to rotate said poppet;

e) a controlling instrument situated in said housing; and f) a rotary-to-linear motion converter arranged to axially move said poppet relative to said orifice in response to controlling actions of said instrument.

8. The apparatus of claim 7 wherein said housing is removably supported in a muleshoe in said body such that said housing may be removably installed in said drill string after said drill string is suspended in said well bore.

9. The apparatus of claim 7 wherein said orifice is supported in said body, external of said housing.

10. The apparatus of claim 7 wherein said orifice is supported in said housing.

11. The apparatus of claim 7 wherein said motor is powered by movement of said mud stream and comprises turbine vanes situated on said poppet.

12. The apparatus of claim 7 wherein said motor is powered by a by-pass mud stream driven by the pressure difference across said signal valve.

13. The apparatus of claim 7 wherein an electric power producing alternator is provided and driven by said poppet.

14. The apparatus of claim 7 wherein said rotary-to-linear motion converter is a spiral clutch arranged to releasably grip a cylindrical surface on said poppet, in response to electric signals from said instrument.

15. The apparatus of claim 14 wherein said electric signals provide controls to direct power from an alternator, in said housing, to said spiral clutch.

16. The apparatus of claim 7 wherein an unobstructed bore extends axially through the entirety of said apparatus.

17. The apparatus of claim 7 wherein an unobstructed bore extends axially through the entirety of said housing.

18. The apparatus of claim 17 wherein a power source situated some distance from said housing is arranged to transmit energy into said housing by way of inductive coupling introduced by way of said bore.

19. The apparatus of claim 17 wherein at least some of said instrument is situated below said pulser and communicates with said pulser by way of said bore.

* * * * *